US006804945B2

(12) United States Patent
Straaten

(10) Patent No.: US 6,804,945 B2
(45) Date of Patent: Oct. 19, 2004

(54) OPEN-END ROTOR SPINNING MACHINE

(75) Inventor: Paul Straaten, Schwalmtal (DE)

(73) Assignee: W. Schlafhorst AG & Co. (DE)

( * ) Notice: Subject to any disclaimer, the term of this patent is extended or adjusted under 35 U.S.C. 154(b) by 166 days.

(21) Appl. No.: 10/214,517

(22) Filed: Aug. 8, 2002

(65) Prior Publication Data

US 2003/0029155 A1 Feb. 13, 2003

(30) Foreign Application Priority Data

Aug. 9, 2001 (DE) ..... 101 39 074

(51) Int. Cl.[7] ..... D01H 4/50; B65H 69/06
(52) U.S. Cl. ..... 57/263; 57/22; 242/475.6
(58) Field of Search ..... 57/22, 23, 202, 57/261, 263, 279, 280; 242/475.6, 285.9

(56) References Cited

U.S. PATENT DOCUMENTS

| | | | | |
|---|---|---|---|---|
| 4,041,684 A | | 8/1977 | Kamp | 57/34 R |
| 4,093,133 A | * | 6/1978 | Hoffmann et al. | 242/476.4 |
| 4,356,691 A | * | 11/1982 | Karl et al. | 57/263 |
| 6,221,121 B1 | | 4/2001 | Schelter et al. | 55/467 |

FOREIGN PATENT DOCUMENTS

| | | | | |
|---|---|---|---|---|
| DE | 25 41 589 A1 | | 3/1977 | |
| DE | 198 27 605 A1 | | 12/1999 | |
| DE | 198036 065 A1 | | 2/2000 | |
| DE | 10201533 A1 | * | 2/2003 | D01H/4/48 |

OTHER PUBLICATIONS

German Search Report.

* cited by examiner

*Primary Examiner*—Gary L. Welch
*Assistant Examiner*—Shaun R Hurley
(74) *Attorney, Agent, or Firm*—Kennedy Covington Lobdell & Hickman, LLP'

(57) ABSTRACT

An open-end rotor spinning machine having at least two identical work stations, wherein each work station comprises an open-end spinning device for producing a yarn, a winding device with a creel, a yarn cross-winding device for producing a cheese, a vacuum-chargeable, pivotably seated suction nozzle having a yarn catch element arranged thereon, a device for preparing a yarn for piecing, and a stationary yarn guide device wherein the stationary yarn guide device and the yarn catch element are cooperatively arranged for retrieving the yarn from the cheese and transferring the yarn to the open-end spinning device.

10 Claims, 6 Drawing Sheets

OPEN-END ROTOR SPINNING MACHINE

CROSS-REFERENCE TO RELATED APPLICATIONS

This application claims the benefit of German Patent Application DE 10139074.2, filed Aug. 9, 2001, herein incorporated by reference.

FIELD OF THE INVENTION

The present invention relates to an open-end rotor spinning machine, in particular to an open-end rotor spinning machine having at least two identical work stations wherein each work station has a stationary yarn guide device and a yarn catch element being cooperatively arranged.

BACKGROUND OF THE INVENTION

As illustrated in German Patent Publication DE 198 36 065 A1, an open-end spinning machine typically has a plurality of identical work stations arranged in series next to each other. Each work station has an open-end spinning device and a winding device. At each work station, a sliver fed from a spinning can, for example, is spun into a yarn by means of the open-end spinning device and is subsequently wound into a cheese with the aid of the winding device.

The work stations are attended by a service unit that can be moved along the work stations. The service unit automatically intervenes when an interruption such as a yarn break occurs at one of the work stations. In such a case, the service unit moves to the affected work station and positions itself thereat. With a pivotably seated suction nozzle, the service unit searches for the ruptured yarn that has run up on the cheese.

In some situations, the individual work stations may have to wait too long for the service unit. This is the case when, for example, the service unit is still occupied with the elimination of an interruption at another work station. To avoid this delay, it has been proposed to employ several of the service units simultaneously at an open-end spinning machine.

However, service units such as those disclosed in German Patent Publication DE 198 36 065 A1 are all relatively complicated in their construction and, therefore, comparatively expensive.

In addition to the suction nozzle to which a vacuum can be applied, the service unit also has a number of yarn manipulating elements that make it possible for the service unit to search for the yarn that has run up on the cheese after a yarn break and to piece the picked-up yarn to a fiber ring rotating in the open-end spinning device.

A comparable driveable service unit is disclosed in German Patent Publication DE 25 41 589 A1 and is also designed for automatic piecing in the spinning devices of an open-end rotor spinning machine. The service unit of German Patent Publication DE 25 41 589 A1 also has a pivotably seated suction nozzle. The suction nozzle is slit over its entire length and in the area of its pivot axis makes a transition into a slit transfer arm. Moreover, a yarn storage device, as well as a yarn gripper, are installed in the area of the pivot axis of the suction nozzle and the transfer arm. The yarn that has run up on the cheese after a yarn break is pneumatically picked up by the suction nozzle, is inserted into the yarn storage device and is transferred to a yarn clamping and preparation device arranged at the end of the transfer arm.

Thereafter, the prepared yarn is displaced into the area of the spinning device by the pivoting of the transfer arm and is fed back into the spinning device through a small yarn withdrawal tube.

In addition, it is mentioned in German Patent Publication DE 25 41 589 A1 that, although the yarn processing devices of the service unit can be theoretically arranged in a stationary manner at every one of the work stations of the spinning machine, it is considerably more efficient to arrange these relatively elaborate and, therefore, expensive yarn processing devices on a driveable service unit. The driveable service unit then services a multitude of work stations of an open-end spinning device.

SUMMARY OF THE INVENTION

It is accordingly an object of the present invention to create an open-end spinning machine with independent work stations that are relatively simple in their structure.

This object is addressed by an open-end rotor spinning machine having at least two identical work stations, wherein each work station comprises an open-end spinning device for producing a yarn, a winding device with a creel, a yarn cross-winding device for producing a cheese, a vacuum-chargeable, pivotably seated suction nozzle having a yarn catch element arranged thereon, a device for preparing a yarn for piecing, and a stationary yarn guide device wherein the stationary yarn guide device and the yarn catch element are cooperatively arranged for retrieving the yarn from the cheese and transferring the yarn to the open-end spinning device.

The work stations of the open-end rotor spinning machine having a stationary yarn guide device and a yarn catcher element being cooperatively arranged makes it possible to simply pick up a yarn that has run up on the cheese and transfer it into the spinning device.

For example, a suction nozzle that is driven by a step motor as the single motor device and that is a part of the work station can pick up a yarn from the surface of a cheese maintained in the creel of a winding device and dependably transfer the picked-up yarn to a spinning member that is arranged in the open-end spinning device of the respective work station without requiring further manipulating devices.

Therefore, the independent work stations as a whole remain relatively simple in construction and are cost-effective.

Moreover, in the present invention, the design of the work stations allows the immediate and rapid repair of possibly occurring yarn breaks at any time so that the downtime of the work stations caused by yarn breaks can be minimized and, as a result, yarn breaks have a lesser impact on the efficiency of the work stations.

For this reason, it is also possible to efficiently produce less spin-resistant yarn in the work stations in accordance with the present invention.

In accordance with the present invention, it is possible to produce a yarn that has a clearly reduced coefficient of twist as compared to yarn produced by known work stations. Although it is therefore more likely to have possible yarn breaks, the result is a clear increase in the produced yarn length with the same number of rotor revolutions of the spinning device.

The work stations designed in accordance with the present invention result in a considerable increase in productivity of the work stations.

In one embodiment of the present invention, a stationary yarn guide device has a catch border arranged outside of the regular yarn travel path of the work station and has a catch border such that the yarn picked up by the suction nozzle slides when the suction nozzle is pivoted down. In this case, the catch border is arranged in such a way that in the course of the subsequent pivoting-up of the suction nozzle, the yarn remains fixed in place in this catch border and can be taken over by a corresponding yarn catch element arranged on the back of the suction nozzle.

Due to the cooperative arrangement between the stationary yarn guide device and the pivotably seated yarn catch element, it is possible to simply increase the yarn transfer path of the picked-up yarn past the pivot range of the suction nozzle.

In another embodiment, the suction nozzle is connected with the vacuum source by means of a valve that can be controlled by a work station computer. The suction nozzle is thus only charged with a vacuum when needed. This is due to the employment of the valve. Unnecessary air consumption and useless energy consumption are avoided.

In another embodiment of the present invention, the yarn catch element arranged at the back of the suction nozzle is formed from steel sheet metal. In yet another embodiment of the present invention, the yarn catch element has at least one yarn guide edge and a yarn catch border. The yarn catch element may also have a shift plate.

The yarn guide edge may be curved in an S-shape. This assures that in the course of upward pivoting of the suction nozzle, the yarn that is held in readiness in the yarn catch border of the stationary yarn guide device dependably reaches the yarn catch border of the pivotably seated yarn catch element. Preferably, the yarn catch border is V-shaped. The V-shaped yarn catch border assures that during the subsequent pivoting-away of the suction nozzle the yarn is correctly taken along and is transferred to a yarn processing and return device arranged in the open-end spinning device.

In the yarn transfer position of the suction nozzle, the shift plate of the yarn catch element cooperates with an area of a piecing member arranged in the open-end spinning device.

The shift plate that runs up against a corresponding detent of the piecing member pivots the piecing member out of its spinning position into a yarn receiving position such that the yarn can be pneumatically picked up by the piecing member.

It is moreover possible for a yarn centering device, preferably designed as a centering plate, to be arranged in the winding device. For example, this yarn centering device together with a yarn guide edge in the aspirating opening of the suction nozzle assures that the picked-up yarn always travels in a defined position during its conveyance to the piecing member.

It is assured in this way that the yarn correctly slides into the catch border of the stationary yarn guide device and that it is also dependably taken over by the catch border of the pivotably seated yarn catch element.

Further details of the invention can be gathered from a non-limiting exemplary embodiment presented in the following description with reference made to the drawings.

DESCRIPTION OF THE PREFERRED EMBODIMENTS

Figure 1:
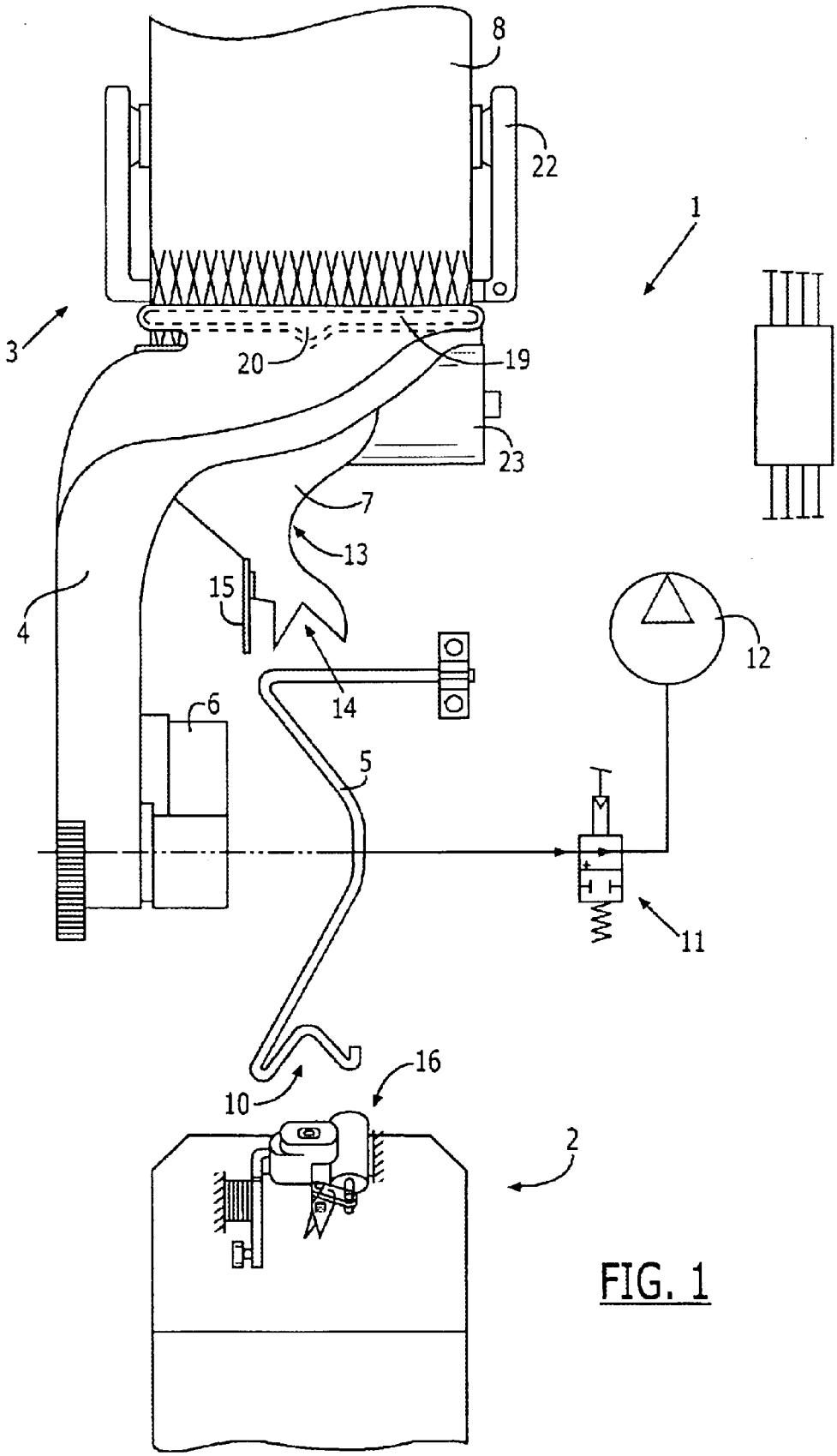
FIG. 1 is a front elevational view of a work station of an open-end rotor spinning machine with a stationary yarn guide device, as well as a yarn catch element on the back of a suction nozzle.
Figure 2:
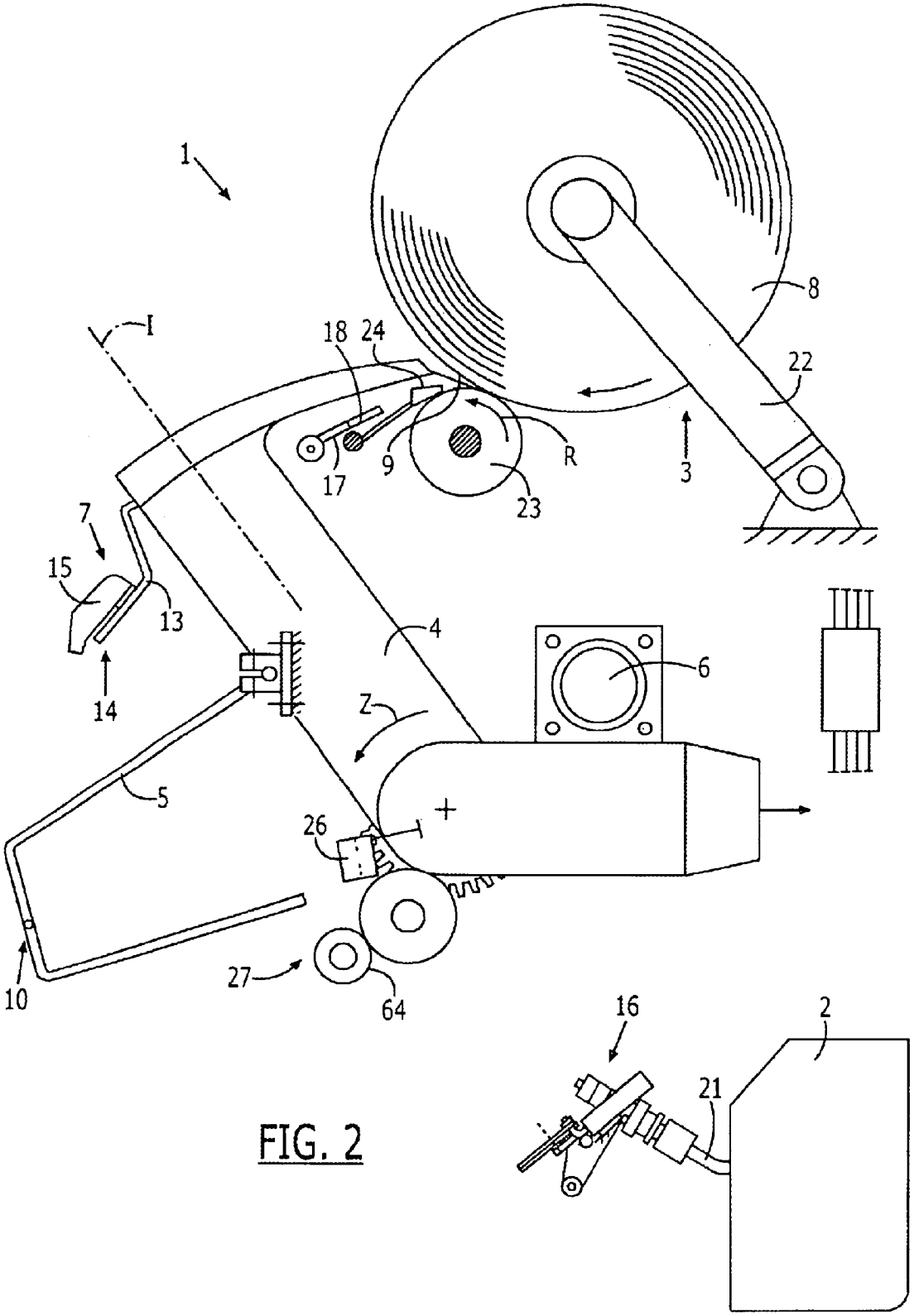
FIG. 2 is a side elevational view of the work station of FIG. 1 at the start of the yarn return.

Work station 1 of an open-end rotor spinning machine, as shown in FIG. 1, has an open-end spinning device 2 and a winding device 3. Furthermore, as shown in FIG. 2, a piecing member 16, a yarn monitor 26, and a yarn withdrawal device 27 are provided at each work station 1.

The pivotably seated piecing member 16 is arranged directly in front of the small yarn withdrawal tube 21 of the open-end spinning device 2. The pivotably seated piecing member 16 prepares the yarn 9 for piecing that, for example, has been retrieved by the suction nozzle 4 from the cheese 8 after a yarn break. Subsequently, the prepared yarn 9 is returned into the open-end spinning device 2 by the yarn withdrawal device 27 via the small yarn withdrawal tube 21 where it is pieced in a known manner to a rotating fiber ring.

As is customary, the winding device 3 consists of a creel 22 for holding a cheese 8, a drive drum 23 that is preferably driven by a separate motor, and a yarn cross-winding device 24 that is driven by a step motor (not represented).

It is possible to arrange a yarn centering device in the form of a centering plate 17 in front of the yarn cross-winding device 24 such that it can be flipped into the regular travel path of the yarn when needed.

Work station 1 also has a suction nozzle 4 that is preferably pivotable by means of a step motor 6 between a yarn pick-up position I and a yarn transfer position II, and the suction nozzle 4 has a yarn catch element 7 on its back.

The yarn catch element 7 has an S-shaped yarn guide edge 13, a yarn catch border 14, and a shift plate 15.

A stationary yarn guide device 5 is arranged in the area in front of the regular yarn travel path. The stationary yarn guide device 5 has a yarn catch border 10 that is open at the bottom.

The stationary yarn guide device 5 and the yarn catch element 7 arranged on the pivotably seated suction nozzle 4 make possible the dependable return of the yarn 9, that had run up on the surface area of the cheese 8 after a yarn break and had been picked up there by the suction nozzle 4, to the piecing member 16, that is a part of the work station where the yarn 9 is prepared and kept ready for the restart of spinning at the respective work station 1.

Figure 6:
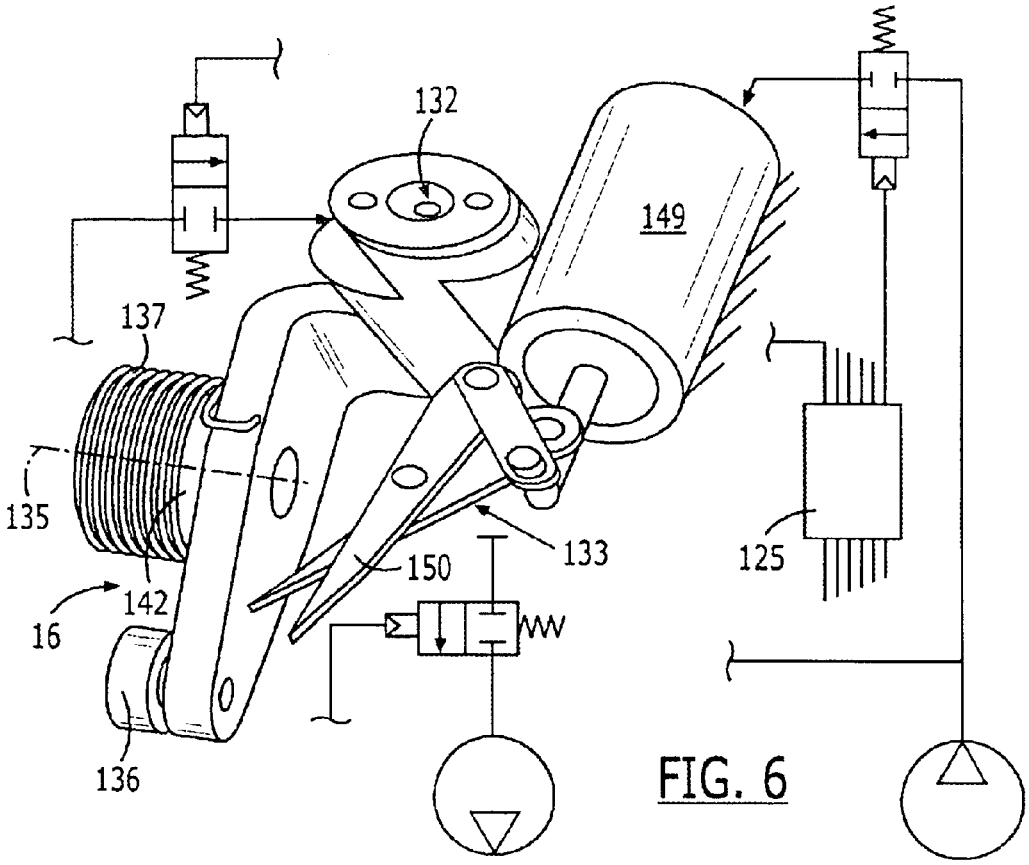
FIG. 6 is an enlarged view of a piecing member that is part of the work station of FIG. 1.
Figure 7:
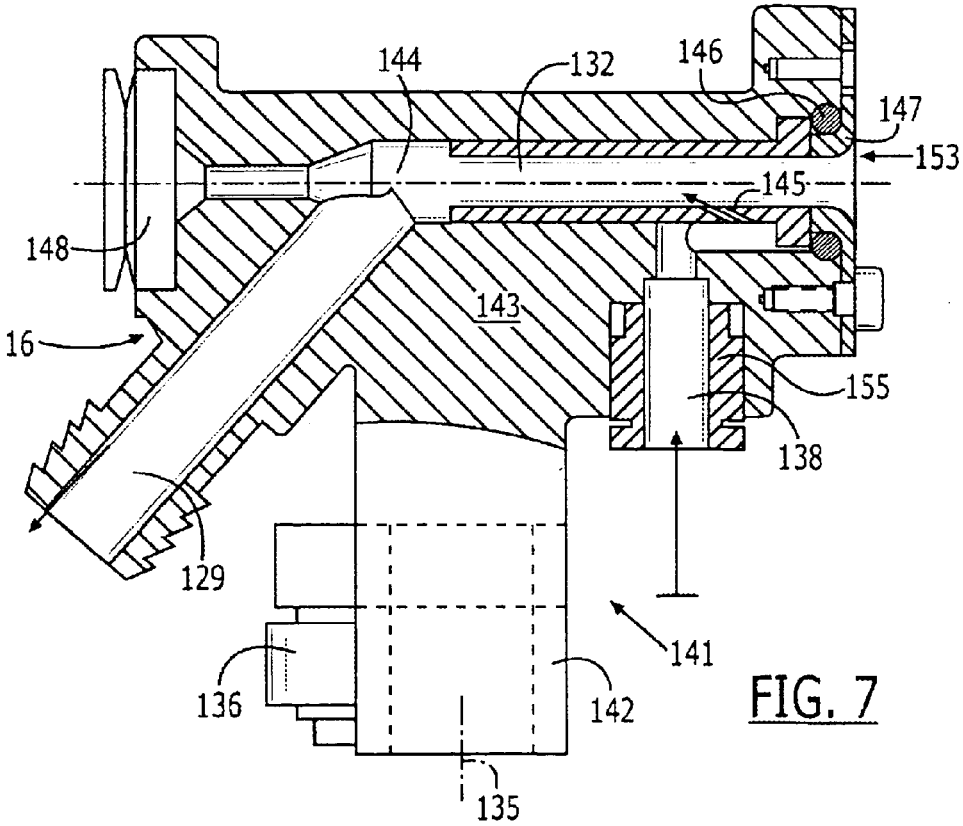
FIG. 7 is a sectional view of a piecing member that is part of the work station of FIG. 1.

As shown in FIGS. 6 and 7, piecing member 16 is a part of the work station.

The piecing member 16 takes up, prepares and keeps the auxiliary yarn presented by the suction nozzle 4 ready for the piecing process. The piecing member 16 substantially consists of a base body 141, preferably produced by means of an injection molding or die casting process, that inter alia has a cylindrical shoulder 142 for receiving a spring element 137.

The pivot axis 135 of the piecing member 16 is also located in the area of this cylindrical shoulder 142. At its end, the base body 141 has a connecting bore for fastening a detent 136, while a receiving housing 143 for a small yarn opening tube 132 is arranged on the opposite side of the base body 141.

In this case, the receiving housing 143 for a small yarn opening tube 132 has a stepped through-bore 144 to which a vacuum connector 129 and a compressed air connector 138 are connected.

Furthermore, a quick-release coupling 155 can be arranged in the area of the compressed air connector 138.

In a known manner, the small yarn opening tube 132 fixed in place in the through-bore 144 has one or several tangential bores 145 through which a compressed air flow can be applied to the yarn end of the auxiliary yarn pneumatically fixed in the small yarn opening tube 132, and the yarn twist can be opened in the process.

As shown in FIG. 7, the small yarn opening tube 132 is fixed in place in the through-bore 144 by means of an O-ring seal 146 or the like, as well as a cover plate 147 that can be screwed on.

A seal 148 is provided on the opposite side of the through-bore 144 adjoining the open-end spinning device 2.

Furthermore, a pneumatically actuable yarn cutting device 133 is arranged in the area of the piecing member 16.

A scissors 150, or the like, is connected to a thrust-piston gear 149 that can be definitely controlled by means of a work station computer 125.

In the course of the spinning process, the yarn 9 produced in the open-end spinning device 2 is withdrawn by means of the yarn withdrawal device 27 and is wound into a cheese 8 on the winding device 3. The surface area of the cheese 8 that is rotatably seated between the arms of a creel 22 rests on a drive drum 23 driven by a separate motor. It is driven by means of a frictional connection. In the process, the yarn 9 is, as is customary, placed by means of a cross-winding device 24 in such a way that it runs up on the surface of the cheese 8 in crossing layers.

Figure 3:
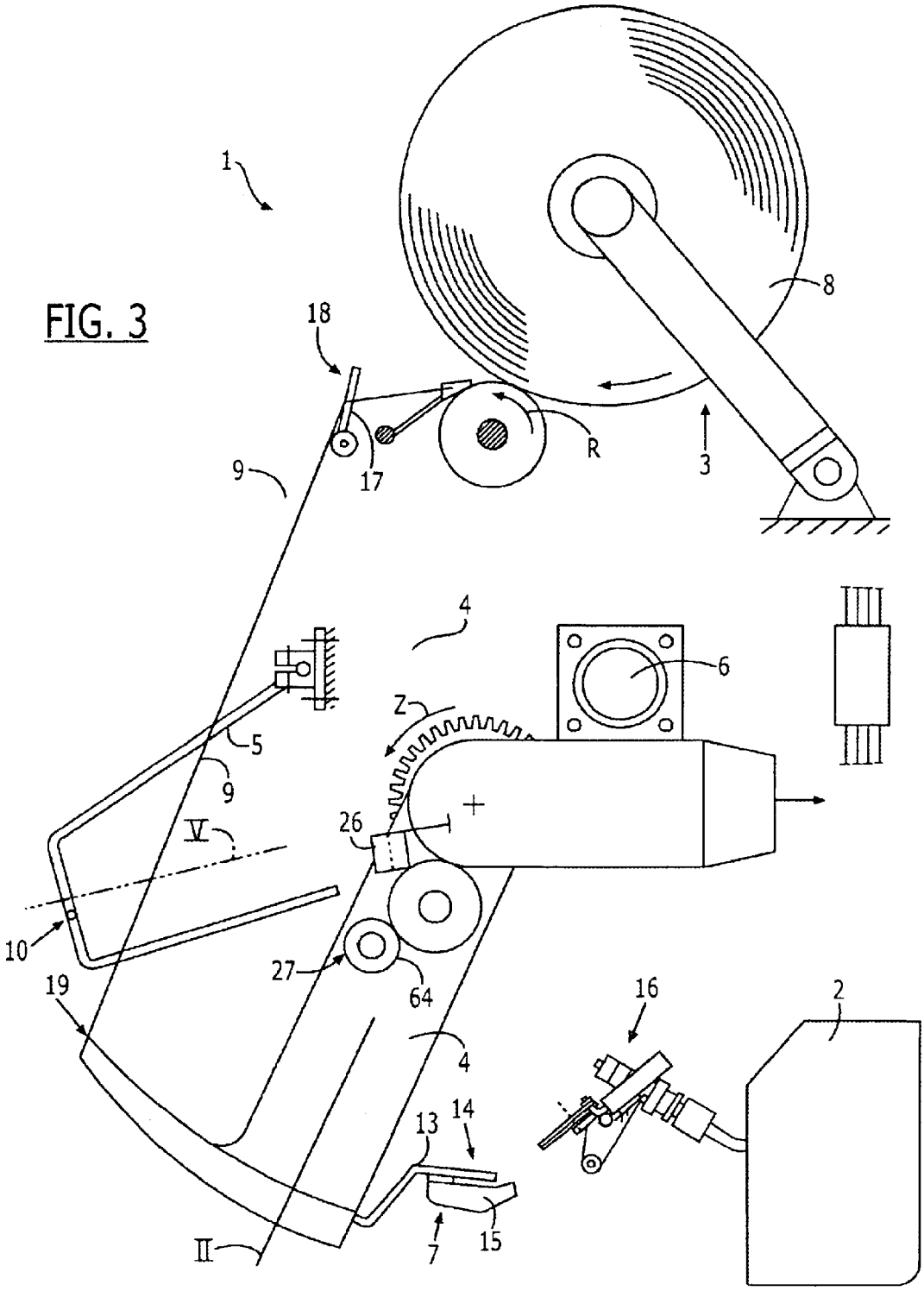
FIG. 3 is another side elevational view of the work station of FIG. 2 during a later phase of the yarn return.

During this spinning process, the suction nozzle 4 is preferably positioned in a parked position V, which is indicated by dashed lines in FIG. 3.

Figure 4:
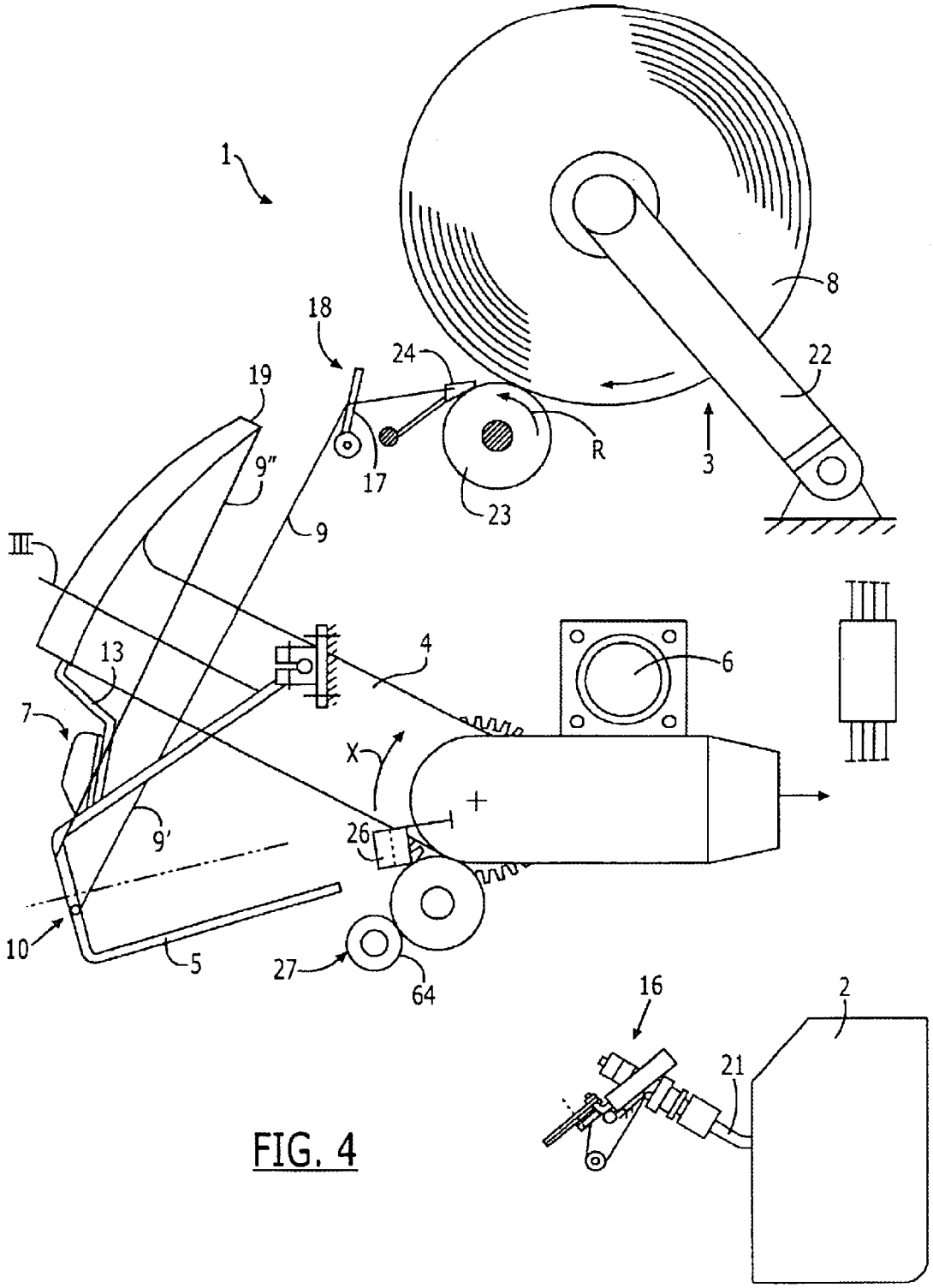
FIG. 4 is yet another side elevational view of the work station of FIG. 2 in a subsequent phase of the yarn return.

At this time the piecing member 16 is in its so-called spinning position represented in FIGS. 2 to 4.

If a yarn break occurs at one of the work stations 1 of the open-end rotor spinning machine and it is detected, for example, by the yarn monitor 26 or a yarn tension force sensor (not represented), the spinning device 2 is first switched off by the work station computer 25 of the respective work station 1 and a braking process is initiated at the associated winding device 3. This means that, for example, the drive mechanism (not represented) of the drive drum 23 is charged with a braking current in the counter-winding direction and is thereby braked to a stop. In the process, the braking drive drum 23 also slows down the cheese 8.

Simultaneously, the work station computer 25 triggers the step motor 6 in such a way that the suction nozzle 4 is pivoted out of its intermediate position II into its yarn receiving position I, in that the aspirating opening 19 of the suction nozzle 4 is positioned in the immediate vicinity of the surface area of the cheese 8. Furthermore, the suction nozzle 4 is pneumatically connected with the vacuum source 12 by opening the valve 11. Subsequently, as indicated in FIG. 2, the drive drum 23 is acted upon in the unwinding direction R in such a way that the yarn end that had run up on the surface area of the cheese 8 can be pneumatically picked up by the suction nozzle 4.

As is known in the art, the successful pickup of the yarn 9 can be either monitored by a sensor device arranged inside the suction nozzle 4 or by means of a yarn monitor 26 arranged in the area of the yarn travel path.

Thereafter, the step motor 6 pivots the suction nozzle 4 downward in the direction Z until it has again reached the intermediate position II.

While the suction nozzle 4 is pivoted downward, it is additionally possible to flip a centering plate 17 that is installed in the area of the winding device 3 into the yarn path so that the yarn 9 is guided exactly in the center of the work station 1 by a yarn guide notch 18 in the centering plate 17, and, for example, by a yarn guide notch 20 in the aspirating opening 19 of the suction nozzle 4 (see FIG. 1).

In the course of downward pivoting of the suction nozzle 4, the yarn strand stretched between the yarn guide notch 18 of the centering plate 17 and the yarn guide notch 20 of the suction nozzle 4 slides along the stationary yarn guide device 5 until the yarn 9 finally slips into the catch border 10, that is open at the bottom of the yarn guide device 5, as indicated in FIG. 3. At this time, the suction nozzle 4 has reached its intermediate position II, as indicated in FIG. 3.

In place of the centering plate 17, it is also possible to provide a yarn centering device (not represented) that, for example, is comprised of an additional stationary guide wire and a special interior contour of the suction nozzle.

Subsequently, the suction nozzle 4 is again pivoted upward in the direction X as indicated in FIG. 4.

In the course of this, the yarn 9 extending between the cheese 8 and the suction nozzle 4 forms a second yarn strand.

This means that a first yarn strand 9' extends between the centering plate 17 and the catch border 10, while the second yarn strand 9" extends between the catch border 10 and the aspirating opening 19 of the suction nozzle.

In the course of upward pivoting of the suction nozzle 4, the yarn catch element 7 is tangent to the yarn strand 9' that glides along the yarn guide edge 13 of the yarn catch element 7 and extends exactly underneath the catch border 14 of the yarn catch element 7 when the suction nozzle 4 has reached its reversing direction III.

This means that with the yarn catch border 14 the suction nozzle 4, that thereafter again pivots downward in the direction Z, crosses the yarn strand 9' and transfers the yarn 9 in the course of this to the piecing member 16 that is arranged in the area of the open-end spinning device 2.

In the course of this second downward movement of the suction nozzle 4, the yarn 9 is inserted into the various yarn guide borders in the yarn travel path as well as into the opened yarn withdrawal device 27. Thereafter, the clamping roller 64 of the yarn withdrawal device 27 is closed again, and the yarn 9 is clamped.

Figure 5:
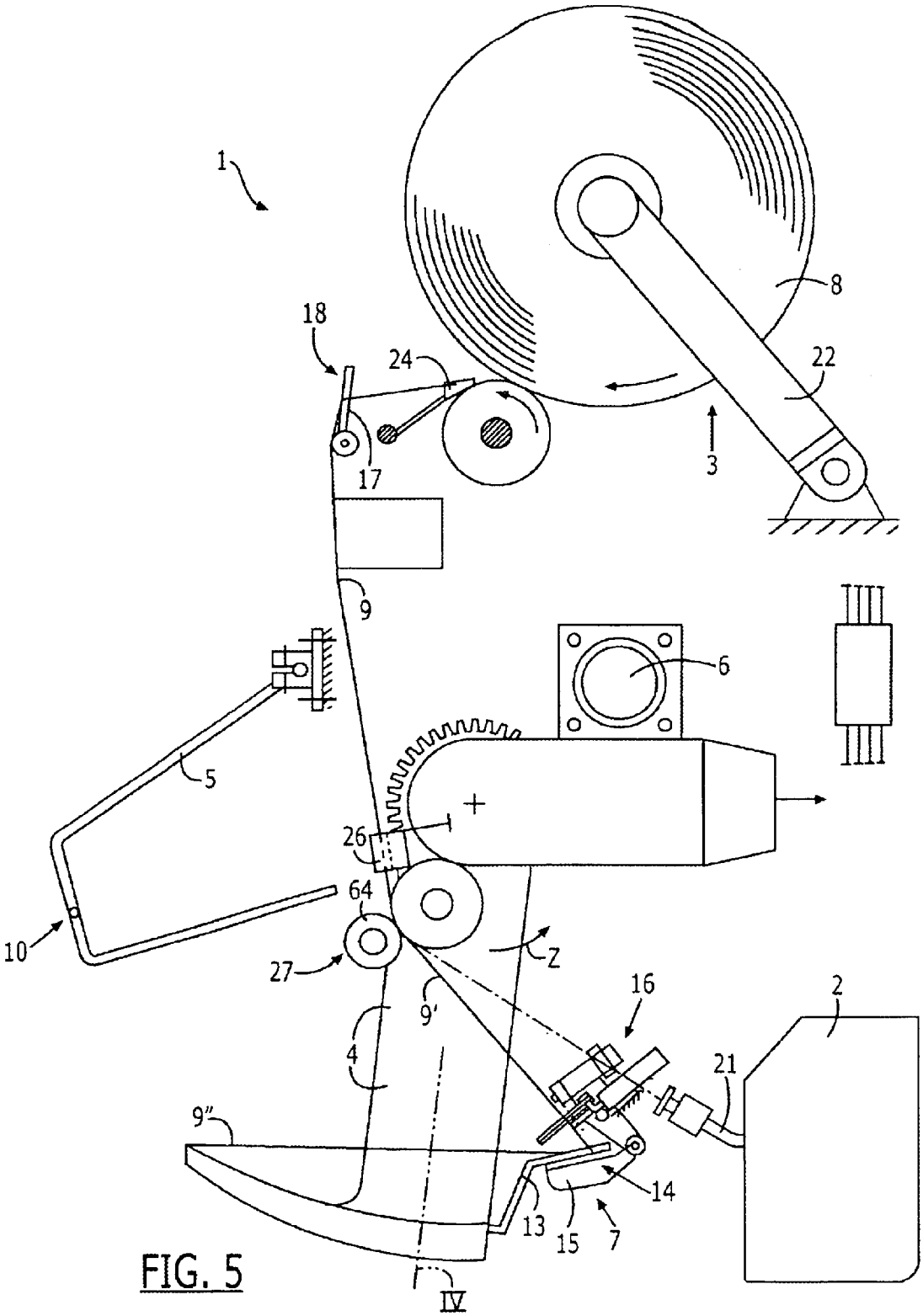
FIG. 5 is a side elevational view of the work station of FIG. 2 during the transfer of the yarn to a spinning member that is a part of the work station.

When the suction nozzle 4 pivots into the yarn transfer position IV, as indicated in FIG. 5, the shift plate 15 arranged on the suction nozzle 4 moves against a corresponding detent of the pivotably seated piecing member 16.

In the process, the piecing member 16 is pivoted out of the spinning position indicated in FIGS. 2 to 4 into the yarn take-over position represented in FIG. 5, in that its yarn outlet opening is positioned directly above the yarn strand 9'.

The yarn 9 is now cut and the piecing member 16 that is pneumatically charged, takes over the yarn 9. While the end of the yarn strand 9' is prepared for the resumption of spinning by the open-end spinning device 2 in the piecing member 16, the yarn strand 9" is disposed of through the suction nozzle 4. The suction nozzle 4 is then pivoted back into the parked position V by means of its drive mechanism 6 and in the process releases the piecing member 16.

Acted upon by the spring element 37, the piecing member 16 then rotates back into its spinning position.

Thereafter, the prepared yarn 9 is fed back into the open-end spinning device 2 by the yarn withdrawal device 27 via the small yarn withdrawal tube 21 and is placed there against a rotating fiber ring.

Subsequently, the new yarn 9 is withdrawn by means of the yarn withdrawal device 27 that is a part of the work station, and, as already mentioned at the outset, is wound into a cheese 8 on the winding device 3.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An open-end rotor spinning machine having at least two identical work stations, wherein each work station comprises an open-end spinning device for producing a yarn, a winding device with a creel, a yarn cross-winding device for producing a cheese, a vacuum-chargeable, pivotably seated suction nozzle having a yarn catch element arranged thereon, a device for preparing a yarn for piecing, and a stationary yarn guide device, wherein the stationary yarn guide device and the yarn catch element are cooperatively arranged for retrieving the yarn from the cheese and transferring the yarn to the open-end spinning device.

2. The open-end spinning machine according to claim 1, wherein the stationary yarn guide device is arranged outside of a normal yarn travel path of the work station and is operative to insert the yarn retrieved by the suction nozzle into a catch border of the yarn guide device when the suction nozzle pivots into an intermediate position.

3. The open-end spinning machine according to claim 1, wherein the suction nozzle is connected with a vacuum source by means of a valve that can be controlled by a work station computer.

4. The open-end spinning machine according to claim 1, wherein the yarn catch element has at least one yarn guide edge and a yarn catch border.

5. The open-end spinning machine according to claim 4, wherein the yarn guide edge is of a curved S-shape.

6. The open-end spinning machine according to claim 4, wherein the yarn catch border is of a V-shape.

7. The open-end spinning machine according to claim 1, wherein the yarn catch element has a shift plate.

8. The open-end spinning machine according to claim 7, wherein, in a yarn transfer position of the suction nozzle, the shift plate of the yarn catch element cooperates with a pivotably seated yarn processing and return device arranged in the open-end spinning device.

9. The open-end spinning machine according to claim 1, wherein the winding device has a yarn centering device.

10. The open-end spinning machine according to claim 1, wherein a yarn centering device comprises a pivotably seated centering plate having a yarn guide notch arranged at its center.

* * * * *